US005720705A

United States Patent [19]

Inge et al.

[11] Patent Number: 5,720,705

[45] Date of Patent: Feb. 24, 1998

[54] METHOD FOR FREEING A LIQUID FROM A SUBSTANCE DISPERSED THEREIN AND HAVING A LARGER DENSITY THAN THE LIQUID

[75] Inventors: Claes Inge, Saltsjö-Duvnäs; Peter Franzén, Tullinge; Torgny Lagerstedt, Stockholm; Leonard Borgström, Bandhagen; Claes-Göran Carlsson, Tullinge; Hans Moberg, Stockholm; Olle Nåbo, Tullinge, all of Sweden

[73] Assignee: Alfa-Laval Separation AB, Tumba, Sweden

[21] Appl. No.: 681,527

[22] PCT Filed: Oct. 27, 1989

[86] PCT No.: PCT/SE89/00598

§ 371 Date: May 8, 1991

§ 102(e) Date: May 8, 1991

[87] PCT Pub. No.: WO90/05028

PCT Pub. Date: May 17, 1990

[30] Foreign Application Priority Data

Nov. 8, 1988 [SE] Sweden ..... 8804029

[51] Int. Cl.[6] ..... B04B 1/08

[52] U.S. Cl. ..... 494/37; 494/70; 494/71

[58] Field of Search ..... 494/37, 43, 68, 494/69, 70, 71, 72, 73, 80; 210/781, 782

[56] References Cited

U.S. PATENT DOCUMENTS

| | | | |
|---|---|---|---|
| 355,050 | 12/1886 | Backstrom | 494/43 |
| 432,719 | 7/1890 | Bechtolsheim | 494/37 |
| 902,913 | 11/1908 | Risberg | 494/70 |
| 945,903 | 1/1910 | Bailey | 494/70 |
| 958,769 | 5/1910 | Richardson | 494/37 |
| 1,006,622 | 10/1911 | Bailey | 494/73 |
| 1,208,461 | 12/1916 | Blanc | 494/43 |
| 1,356,665 | 10/1920 | Sturgeon | 494/37 |
| 1,718,081 | 6/1929 | Ruda | 494/43 |
| 2,081,406 | 5/1937 | Mazza | 494/37 |
| 2,331,352 | 10/1943 | Sharples | 494/37 |
| 2,578,485 | 12/1951 | Nyrop | 494/71 |
| 2,690,900 | 10/1954 | Zachariassen | 494/70 |
| 2,748,668 | 6/1956 | Hornbostel | 494/56 |
| 2,910,226 | 10/1959 | Thylefors | 494/70 |
| 3,376,360 | 4/1968 | Feezel | 494/37 |
| 3,606,147 | 9/1971 | Broadbent | 494/43 |
| 3,771,353 | 11/1973 | Jenkins | 494/37 |
| 4,262,841 | 4/1981 | Berber | 494/73 |
| 4,427,407 | 1/1984 | Pashedag | 494/70 |

FOREIGN PATENT DOCUMENTS

| | | | |
|---|---|---|---|
| 3201866 | 8/1983 | Germany | 494/43 |
| 70154 | 9/1930 | Sweden | 494/43 |
| 206941 | 2/1968 | U.S.S.R. | 494/70 |
| 1271576 | 11/1986 | U.S.S.R. | 494/43 |
| 1346257 | 10/1987 | U.S.S.R. | 494/43 |

*Primary Examiner*—Terrence Till

*Attorney, Agent, or Firm*—Seidel Gonda, Lavorgna & Monaco, PC

[57] ABSTRACT

In order to free a liquid form a substance dispersed therein and having a larger density than the liquid a centrifuge rotor is used having a stack of conical separation discs. Elongated spacing members (11*a*, 11*b*) in the spaces between the separation discs are formed such that the liquid flow in the disc interspaces is conducted in a certain way. Thus, the main part of the liquid is conducted in flow paths (12*a*, 12*b*), each of which has a direction with one radial component and one component turned against the rotational direction of the rotor.

3 Claims, 2 Drawing Sheets

Figure 1:
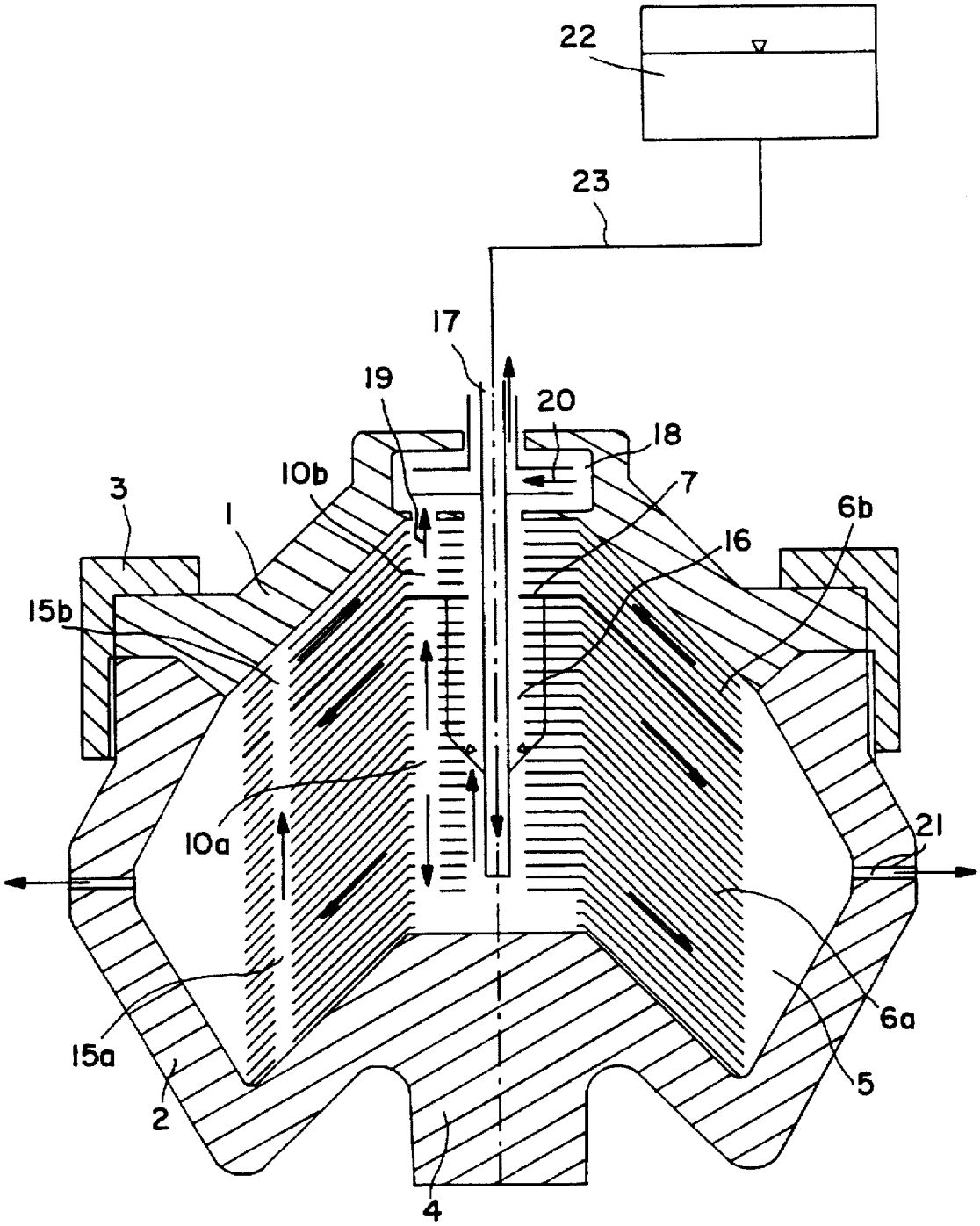

METHOD FOR FREEING A LIQUID FROM A SUBSTANCE DISPERSED THEREIN AND HAVING A LARGER DENSITY THAN THE LIQUID

The present invention relates to a method of freeing a liquid from a substance dispersed therein and having a larger density than the liquid, and a plant for performing said method. A plant of the kind to which the invention is related includes, apart from a source of liquid of said kind, a centrifugal separator comprising a rotor, which is rotatable in a predetermined direction and defines a separation chamber; a stack of conical separation discs arranged coaxially with the rotor in the separation chamber; spacing means formed and arranged between the separation discs such that they define several flow paths between two adjacent separation discs, each of which flow paths has an inlet part and an outlet part situated at different distances from the rotational axis of the rotor; means for the supply of liquid from said source to the inlet part of each flow Path; and means for removing liquid having been freed from said dispersed substance from the outlet part of each flow path.

Centrifugal separators of this kind have been known for a long time. In these centrifugal separators said flow paths between the separation discs usually are delimited by radially extending spacing means between the separation discs. If inlet channels for a liquid are formed by axially aligned distribution holes in the separation discs, these distribution holes most often are placed between and are equally spaced from the radially extending spacing means. However, proposals have been made to place said holes, instead, close to the spacing means and to give the spacing means an extension other than a pure radial extension. Such proposals have been made for instance in the Swedish patent specification 156,317.

The object of the present invention has been to provide a centrifugal separator of the initially described kind having a better separation efficiency than previously known centrifugal separators intended for the separation of a substance dispersed in a carrying liquid and having a larger density than the latter. The substance in question may be constituted by solids but, alternatively, it can be constituted by particles of a liquid other than the carrying liquid.

This object is achieved according to the invention in a centrifugal separator of this kind in that two adjacent spacing members between two adjacent separation discs are shaded such that they form between themselves a flow path extending from its inlet part to its outlet part in a direction which has one radial component and one component in the circumferential direction of the rotor and turned against or opposite to the predetermined rotational direction of the rotor.

A comparison between a centrifugal separator designed in this manner and a centrifugal separator designed in a conventional manner and having distribution holes of the above described kind placed between and equally spaced from radially extending spacing means between the separation discs, has shown that the separation efficiency could be 20–50% better with the invention than with the previously known centrifugal separator. The reason why the separation efficiency can be improved by means of the invention is assumed to be the following.

In a conventionally designed centrifugal separator, in which the supplied liquid is intended to flow radially inwards along the above described flow paths, a large part of the actual liquid transport between the inlets and outlets of the flow paths takes place in very thin boundary layers, so called Ekman-layers, formed on the surfaces of the separation discs. A free liquid flow of a substantial magnitude, a so called geostrophic flow, will come up between the two boundary layers in each interspace between adjacent separation discs, but this liquid flow is directed substantially in the circumferential direction of the rotor and, also, forms local eddies between the separation discs, particularly close to the above mentioned distribution holes therein.

In the said boundary layers the liquid to a large extent flows radially inwards in the rotor both along the separation disc surfaces, towards which separated liquid moves, and along the surfaces towards which the somewhat heavier substance dispersed in the liquid moves as a consequence of the centrifugal force. In the boundary layers along the last mentioned surfaces the radially inwards directed liquid flow subjects the dispersed substance, which is brought close to these surfaces by the centrifugal force, to undesired shearing forces and, also, counteracts the intended movement of this substance radially outwards along the surfaces.

For avoiding these problems the liquid flow between the separation discs, according to the invention, is controlled in a way such that the liquid flow in the boundary layers formed on the surfaces of the separation discs gets a direction such that the separation of the relatively heavy dispersed substance is facilitated.

The invention can be applied in connection with a radially outwards directed liquid flow in the interspaces between the separation discs as well as in connection with a radially inwards directed such liquid flow. In the first said case the said flow paths should extend such that the liquid in question automatically is caused to flow substantially in the longitudinal direction of these flow paths as a consequence of the rotor rotation. In the last mentioned case, however, the flow paths should extend such that the liquid is prevented by the spacing means from flowing its natural way towards the rotor axis, induced by the rotor rotation and, instead, is forced to flow in a different direction. However, in both cases it is achieved by the invention that the main part of the actual liquid flow between the inlet and the outlet of each flow path will come up in the interspace between the two boundary layers which are formed on the surfaces of the separation discs in question. Hereby, a flow resistance is obtained for the liquid, which is substantially lower than the corresponding flow resistance in centrifugal separators of the known kind, in which the actual liquid flow between the inlets and the outlets of the flow paths takes place substantially in the thin boundary layers formed on the separation disc surfaces.

After having reached the boundary layer formed on the underside of each separation disc the relatively heavy dispersed substance will flow more or less radially outwards in each flow path and leave the latter at the radially outer edge of said separation disc. In order to disturb to a minimum the radially outwards directed flow of the dispersed substance, the axial flow of liquid taking place near the radially outer edges of the separation discs preferably should be confined, in a centrifugal separator of the invention, to limited parts of the disc stack circumference.

Therefore, in the case of a radially outwards directed liquid flow in a flow path between two separation discs there should be means forming a passage for discharge of liquid having been freed from dispersed heavy substance, which passage communicates with the outlet part of said flow path near the rear portion thereof, seen in the rotational direction of the rotor. This is because the radial outflow of separated heavy dispersed substance, in this case, will be least in this rear portion of the flow path outlet part.

In the case of a radially inwards directed liquid flow in a flow path between two separation discs there should be corresponding means forming a passage for introduction of liquid to be freed from dispersed heavy substance, which passage communicates with the inlet part of said flow path near the forward portion thereof, seen in the rotational direction of the rotor. In this case, namely, the radial outflow of separated heavy dispersed substance will be least in this forward portion of the flow path inlet part.

Said passage forming means, in its most simple form, could be constituted by perforated parts of the separation discs. In other words, at least one of the two separation discs delimiting a flow path could have a through hole for axial transport of liquid to or from the flow path at the relevant portion of its inlet part or outlet part, respectively.

As an alternative, the passage forming means could be in the form of axially extending partition means delimiting axial channels radially outside but close to the edges of the separation discs and leaving between themselves interspaces for the radial outflow of separated heavy dispersed substance from the various flow paths to the radially outermost part of the separation chamber, i.e. the so called sludge space of the separation chamber.

According to a further alternative, the above said passages may be formed by axially aligned recesses in the radially outer edges of the separation discs, said recesses thus forming radially open and axially extending grooves in the stack of separation discs.

Figure 3:
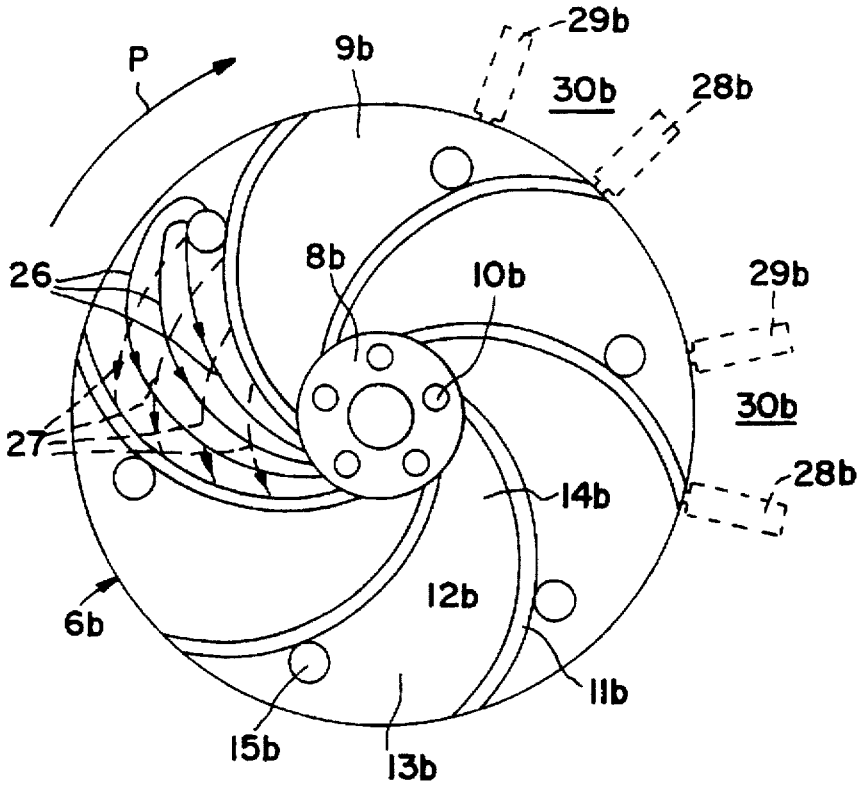
Figure 2:
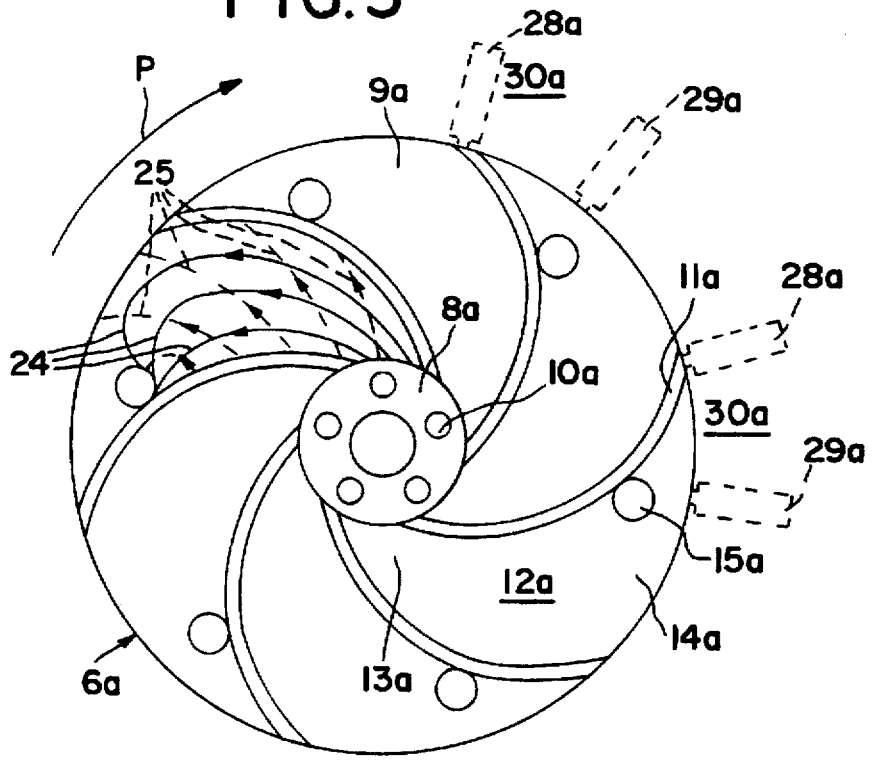

The invention is described in the following with reference to the accompanying drawing. In the drawing FIG. 1 shows an axial section through a centrifuge rotor that is provided with separation discs designed according to the invention. FIG. 2 and FIG. 3 illustrate two different kinds of separation discs used in a centrifuge rotor according to FIG. 1.

FIG. 1 shows a centrifuge rotor comprising an upper part 1 and a lower part 2. The parts 1 and 2 are kept together axially by means of a locking ring 3. The centrifuge rotor is supported by a drive shaft 4 connected with the lower rotor part 2.

The rotor parts 1 and 2 form a separation chamber 5, in which two stacks of partly conical separation discs **6*a* and 6*b* are arranged coaxially with the rotor. A partly conical partition 7 is placed between the stacks of separation discs 6*a* and 6*b*. The separation discs as well as the partition are fixed radially and in their circumferential direction relative to each other and relative to the rotor by means of a number of rods (not shown), which extend axially through both of the stacks of separation discs 6*a* and 6*b* and through the partition 7 and which at their ends are connected with the rotor parts 1 and 2**, respectively.

FIG. 2 shows a separation disc **6*a***, seen from above. An arrow P illustrates the intended rotational direction of the rotor and, thus, that of the separation disc.

The separation disc **6*a* comprises a central annular plane portion 8*a* and a conical portion 9*a*. The plane portion 8*a* has several axial through holes 10*a* placed in a ring around the separation disc centre. The conical portion 9*a* has on its upper side several bent spacing members 11*a*, which are evenly distributed around the separation disc centre and extend from the central plane portion 8*a* no the circumferential edge of the separation disc. The spacing members 11*a*, which are bent backwards in relation to the intended rotational direction, are arranged in the stack of separation discs 6*a* (FIG. 1) to create flow paths between two adjacent separation discs for a liquid to be treated. One flow bath of this kind formed between two spacing members 11*a* is designated 12*a* in FIG. 2. The flow path 12*a* has an inlet part 13*a* situated close to the central plane portion 8*a* of the separation disc, and an outlet part 14*a* situated close to the circumferential edge of the separation disc 6*a*. In the outlet part 14*a* of each flow path the separation disc 6*a*—in the vicinity of the rear spacing member 11*a* seen in the intended rotational direction—has an axial through hole 15*a***.

FIG. 3 shows a separation disc **6*b* seen from above. An arrow P illustrates that the separation disc 6*b* is intended to rotate in the same direction as the separation disc 6*a*** in FIG. 2.

The separation disc **6*b* comprises a central annular plane portion 8*b* and a conical portion 9*b*. The plane portion 8*b* has several axial through holes 10*b* placed in a ring around the separation disc centre. The conical portion 9*b* has on its upper side several bent spacing members 11*b*, which are evenly distributed around the separation disc centre and extend from the central plane portion 8*b* the circumferential edge of the separation disc. The spacing members 11*b*, which are bent forwards with reference to the intended rotational direction, are aranged in the stack of separation discs 6*b* (FIG. 1) to create flow ways between two adjacent separation discs for a liquid to be treated. One flow path of this kind between two spacing members 11*b* is designated 12*b* in FIG. 2. The flow way 12*b* has an inlet part 13*b*, situated close to the circumferential edge of the separation disc 6*b*, and an outlet part 14*b* situated close to the central plane portion 8*b* of the separation disc. In the inlet part 13*b* of each flow path the separation disc 6*b*—close to the forward spacing member 11*b* seen in the intended rotational direction—has an axial through hole 15*b***.

As can be seen from FIG. 1, the holes **10*a* of the separation discs 6*a* are axially aligned. Hereby, an axial channel is formed through the central part of the lower snack of separation discs. A corresponding axial channel is formed by corresponding holes 10*b* in the separaion discs 6*b* above the partition 7. The partition 7** prevents direct communication between the channels.

In a corresponding way the holes **15*a* and 15*b* in the separation discs 6*a* and 6*b*, respectively, form axial channels through the two stacks of separation discs close to their circumferential edges. Each channel formed by holes 15*a* is situated axially aligned with a channel formed by holes 15*b* and communicates therewith through a hole in the partition 7**.

Centrally in the lower stack of separation discs **6*a* there is formed an inlet chamber 16, into which a stationary inlet pipe 17 extends from the outside of the rotor. The inlet pipe 17 opens in the lower part of the inlet chamber 16, where some of the separation discs 6*a*** have no central plane portions.

In the upper rotor part 1 there is formed a radially inwards open annular outlet chamber 18, which through axial holes 19 communicates with the axial channels formed by the holes **10*b* through the upper separation discs 6*b*. A stationary outlet member 20, e.g. a so called paring member, is supported by the inlet pipe 17 and extends into the outlet chamber 18. There is a possibility (not shown) for free passage of air between the axially upper part of the inlet chamber 16** and the outside of the rotor.

Periferal outlet openings 21 extend through the rotor part 2 from the radially outermost part of the separation chamber 5 to the outside of the rotor.

Above the centrifuge rotor in FIG. 1 there is shown a container 22 which through a conduit 23 is connected to the stationary inlet pipe 17. The container is intended to contain a liquid having a substance dispersed therein, which substance has a larger density than the liquid and is to be separated therefrom.

The centrifuge rotor according to FIG. 1 is intended to operate in the following manner, it being assumed that the substance dispersed in the liquid in the container 22 is constituted by solids.

Liquid from the container 22 is supplied to the lower part of the inlet chamber 16 through the inlet pipe 17. From the opening of the inlet pipe the mixture flows axially upwards in the inlet chamber 16 between the inlet pipe 17 and the radially inner edges of the separation discs 6a. The liquid gradually is distributed in the spaces between some of the central plane portions 8a of the separation discs 6a, in which spaces the liquid while it moves radially outwards is gradually entrained in the rotor rotation by friction coming up between the liquid and said plane portions 8a.

Upon a certain flow of liquid into the inlet chamber 16 there is formed therein a free liquid surface at a level shown in FIG. 1 by a full line and a triangle. Upon an increase of the liquid flow into the inlet chamber 16 the free liquid surface may move to a level higher up in the inlet chamber.

When liquid having entered the spaces between the central portions 8a of the separation discs 6a has been entrained at least partly in the rotor rotation under some radial movement in the spaces, the liquid is distributed axially across the separation disc stack situated below the partition 7. This takes place through the channels formed by the holes 10a (FIG. 1).

After that, liquid flows further on radially outwards between the separation discs 6a, part of the solids suspended in the liquid being separated from the liquid. The solids move towards the undersides of the separation discs 6a and slide along them to the so called sludge space of the separation chamber 5 radially outside the separation discs. The solids leave the rotor through the peripheral outlet opening 21.

Liquid gradually freed from solids flows radially outwards in the flow paths 12a (FIG. 2) between the separation discs 6a, after which it flows axially upwards through the channels formed by the holes 15a and further through the channels formed by the holes 15b in the separation discs 6b. Above the partition 7 the liquid gradually flows into the spaces between the separation discs 6b, in which it is subjected to a further separating operation while in flows along the flow paths 12b (FIG. 3). The liquid leaves the separation chamber through the channels formed by the holes 10b and through the openings 19 and flows further on through the outlet chamber 18 out through the stationary outlet member 20.

The reason why liquid in the inlet chamber 16 will first flow axially upwards between the inlet pipe 17 and the inner edges of the separation discs 6a—and will not flow directly from the opening of the inlet pipe 17 out into the separation chamber through the spaces between the lowermost separation discs 6a—is that the liquid does not rotate when it leaves the opening of the inlet pipe and, therefore, has not a pressure as high as that of the rotating liquid which is present close to the conical portions of the lowermost separation discs 6a in the lower part of the inlet chamber 16.

During its flow along the flow paths 12a between the separation discs 6a (FIG. 2) the main part of the liquid will follow flow lines 24 of the kind shown in one of the flow paths 12a. This liquid flow, in the following called "primary liquid flow", thus has a direction with one radially outwards directed component and one component directed in the circumferential direction of the rotor opposite to its rotational direction.

As a consequence of said primary liquid flow and as a consequence of the rotor rotation another liquid flow, in the following called "secondary liquid flow", will come up in thin boundary layers—so called Ekman layers—on the surfaces of the separation discs delimiting the flow paths 12a. In these Ekman layers the liquid flows in ocher directions than the direction of the primary liquid flow. Thus, the liquid in the part of an Ekman layer, that is situated closest to the surface of the separation disc in question, flows in those directions illustrated by means of dotted flow lines 25 in FIG. 2. According to known theories for liquid flow close to a body in a rotating system the flow lines 25 form an angle of 45° wish the flow lines 24 for the so called primary liquid flow. In parts of the Ekman layer, which are situated more remote from the separation disc surface, the liquid flows in directions which form gradually smaller angles with the flow lines 24 the larger the distance is from the surface of the separation disc 6a.

While the liquid flows in the spaces between the separation discs 6a, the solids suspended in the liquid are moved by the centrifugal force radially outwards towards she undersides of the separation discs. When the particles approach these undersides they are entrained by the so called secondary liquid flow close to these undersides and they adopt gradually a direction of movement approaching the direction of the dotted flow lines 25. Thus, while liquid gradually freed from particles moves along the full flow lines 24 towards the holes 15a in the separation discs 6a, solids are separated from the liquid. The solids move in a direction towards the spacing member 11a situated ahead of the flow path 12a seen in the rotational direction of the rotor. When the solids have reached this spacing member 11a, they are forced by the centrifugal force to move along the spacing member towards the circumferential edge of the separation disc. From there they are thrown out into the so called sludge space of the separation chamber, from where they leave through the outlet holes 21 in the rotor part 2.

Liquid having been freed from solids flows from the outlet parts 14a of the different flow paths 12a through the holes 15a axially upwards (FIG. 1) past the partition 7 and further through the holes 15b in the separation discs 6b into the spaces therebetween. In these spaces the liquid is conducted by the spacing members 11b (FIG. 3) along the flow paths 12b towards the rotor centre.

During its flow along the flow paths 12b between the separation discs 6b the main part of the liquid will follow flow lines 26 of a kind shown in one of the flow paths 12b. This liquid flow, i.e. the so called primary liquid flow, has a direction with one component directed radially inwards and one component directed against the rotational direction of the rotor.

As a consequence of the primary liquid flow and the rotation of the rotor a secondary liquid flow will come up in Ekman layers on the surfaces of the separation discs 6b. In the part of each Ekman layer, which is situated closest to the surface of the separation disc in question, the liquid flows in those directions which are illustrated by means of dotted flow lines 27 in FIG. 3. The flow lines 27 form an angle of 45° with the flow lines 26 for the primary liquid flow. In the other parts of the Ekman layer the liquid flows in directions which form gradually smaller angles with flow lines 26 the larger the distance is from the surface of the separation disc 6b.

While the liquid flows in the spaces between the separation discs 6b, solids remaining in the liquid are moved by the centrifugal force radially outwards towards the undersides of the separation discs. When the solids approach these undersides they are entrained by the secondary liquid flow in the Ekman layers close to these undersides, and they will gradually adopt a direction of movement approaching the direction of the dotted flow lines 27. Thus, whereas liquid gradually freed from further solids moves along the flow lines 26 towards the rotor centre, solids are separated from the liquid. The solids move in a direction towards the spacing member **11*b* situated behind the flow path 12*b* seen in the rotational direction of the rotor. When the solids have reached this spacing member 11*b*, they are forced by the centrifugal force to move along the spacing member towards the circumferential edge of the separation disc. From there the solids are thrown out into the so called sludge space and further out through the outlet holes 21 in the rotor part 2**.

Liquid having been freed from solids flows from the outlet portions **14*b* of the different flow paths 12*b* through the holes 10*b* axially upwards and out into the outlet chamber 18 of the rotor. From there the liquid is removed by means of the stationary outlet member 20**.

In FIG. 1 there is shown a relatively high stack of separation discs **6*a* and a relatively low stack of separation discs 6*b***. This is just an example. Empirical tests may prove which relation between the heights of the different stacks that would give the best possible separation result.

Another possibility of using in one and the same centrifuge rotor both a radially outwards directed liquid flow and a radially inwards directed liquid flow is offered if the invention is combined with a rotor design of the kind to be seen in U.S. Pat. No. 3,606,147. At a rotor design of this kind liquid would flow radially outwards in every second space between the conical separation discs and radially inwards in the other disc interspaces. Thus, liquid would flow radially outwards in disc interspaces having flow paths **12*a* of the kind shown in FIG. 2 and radially inwards in disc interspaces having flow paths 12*b* of the kind shown in FIG. 3. The last mentioned disc interspaces in this case would be closed radially inwards and communicate with each other and with a rotor outlet through for instance tubular members, which bridge the other disc interspaces close to the axis of the rotor. In the same way as in FIG. 2 and 3 the disc interspace even in this case could communicate with each other through holes 15*a*, 15*b*** close to the circumferential edges of the separation discs.

In many separation cases it may prove suitable, however, as is normally the case, to use only a radially outwards directed flow or a radially inwards directed flow in all of the disc interspaces of the centrifuge rotor.

In FIG. 2 and 3 the spacing members **11*a*, 11*b*** are shown arcuate. Other shapes for the spacing members are possible, however, for conducting the main part of the liquid in the intended flow direction.

In FIG. 1–3 through holes **15*a* and 15*b* form axial channels extending through the respective stacks of separation discs. The holes 15*a* form axial discharge channels from the outlet parts of the flow paths 12*a*, and the holes 15*b* form axial inlet channels to the inlet parts of the flow paths 12*b***.

Alternatively, the holes **15*a* and 15*b*** may be replaced by recesses at the edges of the separation discs, such that they form axially extending and radially outwards open discharge or inlet grooves on the outside of the disc stack.

A further alternative is indicated by dotted lines in FIG. 2 and FIG. 3. As can be understood from FIG. 2, axially and radially extending baffle members **28*a* and 29*a* form between themselves discharge passages or channels 30*a* extending axially past several flow paths 12*a* radially outside of but close to the stack of separation discs. Each discharge channel 30*a* communicates with the outlet parts of several flow paths 12*a* at the rear portions thereof, seen in the rotational direction P of the rotor. The forward portion of each flow path outlet part communicates radially outwards with the radially outermost part of the separation chamber 5 through passages situated between adjacent discharge channels 30*a***.

As can be seen from FIG. 3 corresponding baffle members **28*b* and 29*b* form axially extending inlet channels 30*b* communicating with the inlet parts of several flow paths 12*b* at the forward portions thereof, seen in the rotational direction P of the rotor. The rear portion of each flow path inlet part communicates radially outwards with the radially outermost part of the separation chamber 5 between adjacent inlet channels 30*b***.

We claim:

1. A method of freeing a liquid from a substance dispersed therein and having a larger density than the liquid, comprising the steps of: feeding the liquid into a centrifugal separator having a rotor rotated in a predetermined direction about a rotational axis, the rotor having a stack of at least partly conical separation disks arranged coaxially with the rotor for rotation therewith and being axially spaced from each other and spacing means positioned between and bridging the spaces between the separation disks and delimiting several separate flow paths in each space between adjacent disks, the separate flow paths in each said space being distributed about the rotational axis, and each separate flow path extending from an inlet part to an outlet part situated at different distances from the rotational axis; conducting the liquid to the inlet parts of said flow paths and further conducting the liquid through each of the flow paths in a direction having one radial component and one component in the circumferential direction of the rotor opposite the rotational direction of the rotor; and removing liquid freed from the dispersed substance from the outlet parts of said flow paths.

2. A method according to claim 1 wherein the liquid is conducted in one of said flow paths in a direction having one radially outwardly directed component.

3. A method according to claim 1 wherein the liquid is conducted in one of said flow paths in a direction having one radially inwardly directed component.

* * * * *